United States Patent [19]

Jebens

[11] Patent Number: 4,630,735

[45] Date of Patent: Dec. 23, 1986

[54] DISPENSER CARTON FOR DRINKING STRAWS WITH TEAR-OUT DISPENSING OPENING

[76] Inventor: Klaus Jebens, No. 67, Saselheider Strasse, 2000 Hamburg 72, Fed. Rep. of Germany

[21] Appl. No.: 807,151

[22] Filed: Dec. 10, 1985

[30] Foreign Application Priority Data

Dec. 17, 1984 [DE] Fed. Rep. of Germany ..... 3445927

[51] Int. Cl.[4] ..... B65D 5/54

[52] U.S. Cl. ..... 206/611; 206/625; 206/628; 229/75

[58] Field of Search ..... 206/459, 608, 611, 620, 206/625, 628, 634; 229/75

[56] References Cited

U.S. PATENT DOCUMENTS

| | | | |
|---|---|---|---|
| 2,115,673 | 4/1938 | Stompe | 206/620 |
| 3,179,327 | 4/1965 | Burton et al. | 206/620 |
| 3,301,391 | 1/1967 | Guyer | 206/628 |
| 4,044,919 | 8/1977 | Olsen | 206/620 |
| 4,214,662 | 7/1980 | Jonas | 206/620 |

FOREIGN PATENT DOCUMENTS

| | | | |
|---|---|---|---|
| 2035258 | 6/1980 | United Kingdom | 206/620 |

*Primary Examiner*—William Price
*Assistant Examiner*—Gary E. Elkins
*Attorney, Agent, or Firm*—John C. Smith, Jr.

[57] ABSTRACT

The invention concerns generally the production of a folding box which serves for the reception of a plurality of drinking straws which can be removed from the folding box without touching one or the other end portions of them with the fingers. To attain this end, the blank used for making the folding box is provided with correspondingly arranged perforations which serve when the folding box is to be used for the obtainment of a completely novel arrangement of a pickup opening for the removal of the drinking straws.

2 Claims, 2 Drawing Figures

DISPENSER CARTON FOR DRINKING STRAWS WITH TEAR-OUT DISPENSING OPENING

BACKGROUND OF THE INVENTION

This invention relates to a method of producing a substantially rectangular blank for the production of a folding box intended to be filled with a plurality of drinking straws and provided with a pickup opening for removing the drinking straws from the folding box. Such folding boxes have become known in the public under the trade name "Dispensing Box".

In order to remove one or more drinking straws from a known rectangular folding box it is necessary to open the upper and/or the lower narrow end wall of the folding box. In doing so it is inevitable that at least one end portion of the drinking straw, it may also be a tube of plastic material, is touched with the fingers of the user. This, however, is not desirable for reasons of sterility and hygiene since the danger of catching an infection is very great. This is especially the case in hospitals or the like where a dispensing box is used by several patients.

SUMMARY OF THE INVENTION

It is an object of the present invention to allow the removal of a drinking straw from a folding box in such a manner that a touching of the one or the other end portion of the drinking straw with the fingers is impossible.

To attain this object the present invention proposes to punch perforations into a substantially rectangular foldable blank, to fold the blank into the shape of a folding box having front and rear walls, narrow opposite side walls, and narrow opposite end walls, to close the folding box at all sides by an adhesive with the exception of one of the walls, said wall of the folding box constituting a filling opening and said perforations being arranged in at least one of the walls intermediate the upper and lower edges thereof, to fill the folding box through the filling opening with a plurality of drinking straws, to close the filling opening by an adhesive, and to tear open the perforations to form a pickup opening through which the drinking straws can be removed one by one without the danger of touching the one or the other end portion of the drinking straws with the fingers.

In order to ensure that errors in the manupulation of the folding box are excluded, the blank or the finished folding box may be provided in the vicinity of the perforations with a mark which indicates the manner in which the pickup opening can be torn open easily.

BRIEF DESCRIPTION OF THE DRAWING

An embodiment of the invention will now be described by way of example and with reference to the accompanying drawing in which.

DESCRIPTION OF THE PREFERRED EMBODIMENT

Figure 1:
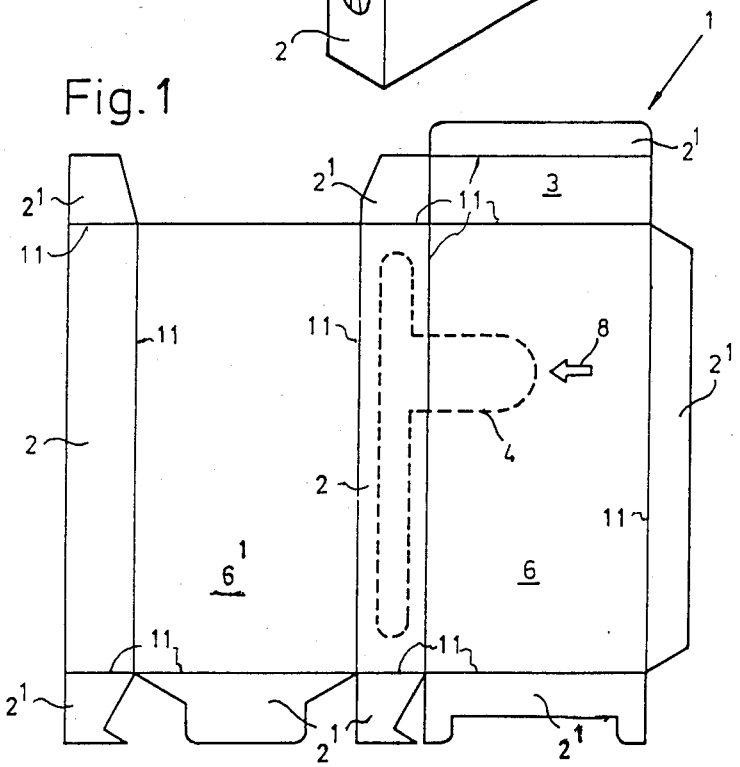
FIG. 1 shows a blank according to the invention.

FIG. 1 shows a substantially rectangular blank 1 for the production of a folding box 5 intended to be filled with a plurality of bendable drinking straws 7 and provided with a pickup opening 10 (FIG. 2) for removing the drinking straws from the folding box. The blank 1 is provided with score lines 11 and flaps $2^1$ so as to provide in overlapping relation, when assembled for use, a front wall 6, a rear wall $6^1$, narrow opposite side walls 2 and narrow opposite end walls 3. The pickup opening 10 is circumscribed by perforations 4 which have been punched into at least one of the walls at a position intermediate the upper and lower edges thereof and can be torn open easily to form the said opening. The perforations 4 are arranged along lines which extend preferably in the transverse direction of the front wall 6 and at the same time in the longitudinal direction of one of the side walls 2 of the folding box.

It is, however, self-evident that the perforations 4 may be arranged along lines which extend only in the longitudinal direction of one of the side walls 2 or in the transverse direction of the front wall 6.

The reference numeral 8 denotes a mark or note which is provided in the vicinity of the perforations to indicate the manner in which the pickup opening 10 can be torn open easily.

Figure 2:
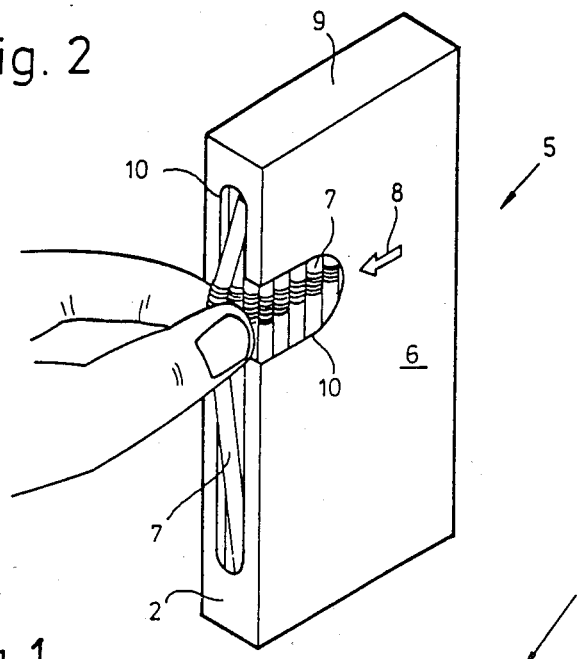
FIG. 2 is a perspective view of a finished folding box filled with a plurality of drinking straws and at the very moment of use.

FIG. 2 shows a finished folding box 5 filled with the drinking straws 7 through a filling opening 9 at the upper end wall 3. The overlapping flaps $2^1$ of all walls have been glued together so that the drinking straws can only be removed through the pickup opening 10 after the perforations 4 have been torn open. The drinking straws have to be removed one by one by gripping each of them with the thumb and the forefinger. It is clear that when doing so, the end portions of the drinking straws will not be touched. It has proved in pratice that instead of bendable drinking straws also rigid drinking straws may be used.

In the embodiment shown in the drawing most-favored drinking straws 7 are used which can be bent in the last third of their length.

The invention may be embodied in other specific forms without departing from the spirit or essential characteristics thereof. The embodiment is therefore to be considered in all respects as illustrative and not restrictive.

What is claimed is:

1. A drinking straw dispenser assembly comprising a dispenser carton containing a group of a plurality of drinking straws of predetermined length and arranged in contiguous, parallel, coextensive relationship; said carton comprising rectangular front and rear walls spaced from each other and having opposite side edges and opposite end edges extending between said opposite side edges; two side walls extending between respective opposite side edges of said front and rear walls, opposite ends of said side walls being in substantial alignment with said opposite end edges of said front and rear walls; and two end walls extending between respective opposite end edges of said front and rear walls and respective ends of said side walls to confine said group of straws within said container; said front wall and one of the adjoining side walls having a tear-out portion defined by a pattern of perforations and comprising a first section in said one side wall which extends in a narrow elongated configuration along a substantial length of said one side wall intermediate the opposite ends thereof, providing portions of said one side wall between opposite ends of said first section of said tear-out portion and the respective ends of said one side wall, the length of said first section of said tear-out portion being less than said predetermined length of said plurality of straws; and a second section which extends laterally from one side of said first section in said one side wall to the junction of said one side wall with the respective side edge of said front wall and from said respective side edge in said front wall for a substantial distance toward the opposite side edge thereof, the width of said second section being substantially less than the length of said first section and said second section being intermediate the opposite ends of said one side wall and the opposite end edges of said front wall; whereby, upon removal of said tear-out portion from said one side and front walls, thereby forming a drinking straw dispensing orifice having an elongated first section in said one side wall and a lateral second section in said one side and front walls, said plurality of drinking straws is retained in said carton by said portions of said one side wall between opposite ends of said first section of said orifice and the respective ends of the said one side wall and individual straws are dispensed from said carton by gripping through said orifice the opposite sides of one of said plurality of straws in said carton intermediate the opposite ends of said one straw and laterally withdrawing said one straw through said first section of said orifice in said one side of said carton without contacting and contaminating the opposite ends of said one straw.

2. A drinking straw dispenser assembly according to claim 1 further comprising a mark on said carton in the vicinity of said perforations indicating the manner in which said tear-out portion may be removed easily.

* * * * *